US010553379B2

(12) United States Patent
Li et al.

(10) Patent No.: US 10,553,379 B2
(45) Date of Patent: Feb. 4, 2020

(54) FLOAT SWITCH

(71) Applicant: SHIMGE PUMP INDUSTRY CO., LTD., Taizhou (CN)

(72) Inventors: Lidong Li, Taizhou (CN); Yansong Yang, Taizhou (CN); Wuwei Fang, Taizhou (CN); Changgui Li, Taizhou (CN)

(73) Assignee: SHIMGE PUMP INDUSTRY CO., LTD., Taizhou (CN)

( * ) Notice: Subject to any disclaimer, the term of this patent is extended or adjusted under 35 U.S.C. 154(b) by 0 days.

(21) Appl. No.: 16/172,920

(22) Filed: Oct. 29, 2018

(65) Prior Publication Data

US 2019/0066952 A1 Feb. 28, 2019

Related U.S. Application Data

(63) Continuation-in-part of application No. PCT/CN2016/090687, filed on Jul. 20, 2016.

(30) Foreign Application Priority Data

Apr. 27, 2016 (CN) ..... 2016 2 0363286 U

(51) Int. Cl.
*H01H 35/18* (2006.01)
*H01H 35/02* (2006.01)

(52) U.S. Cl.
CPC ..... *H01H 35/18* (2013.01); *H01H 35/02* (2013.01)

(58) Field of Classification Search
CPC .... H01H 35/186; H01H 29/20; H01H 35/025; H01H 35/02; H01H 35/18; H01H 36/0033; Y10T 137/8342; Y10T 137/1866; Y10T 137/7287
See application file for complete search history.

(56) References Cited

U.S. PATENT DOCUMENTS 3,254,170 A * 5/1966 Hill ..... H01H 35/18 200/84 B
4,081,638 A * 3/1978 Thorn ..... H01H 35/18 200/84 R
4,629,841 A * 12/1986 Riback ..... H01H 35/186 200/553
6,992,259 B1 * 1/2006 Cantolino ..... H01H 35/18 200/84 R
7,067,750 B1 * 6/2006 Cantolino ..... H01H 35/18 200/84 R
7,471,206 B1 * 12/2008 Ellerman ..... A47G 33/12 340/603

* cited by examiner

*Primary Examiner* — Ahmed M Saeed
(74) *Attorney, Agent, or Firm* — Matthias Scholl P.C.; Matthias Scholl

(57) ABSTRACT

A float switch, including a junction box, a switch, a guide rod, a float, a link mechanism, and a seal assembly. The switch is disposed in the junction box. The junction box is tightly coupled to the link mechanism. The float is flexibly disposed on the guide rod. The link mechanism includes a sealing member, a cylindrical pin, a connecting rod, a support, and a shift fork; one end of the link mechanism is connected to the switch via the shift fork, and the other end of the link mechanism is connected to the guide rod. The support includes a first through hole and a second through hole which are perpendicular to one another. The connecting rod includes a through hole corresponding to the second through hole of the support. The connecting rod runs through the first through hole of the support.

6 Claims, 9 Drawing Sheets

FLOAT SWITCH

CROSS-REFERENCE TO RELATED APPLICATIONS

This application is a continuation-in-part of International Patent Application No. PCT/CN2016/090687 with an international filing date of Jul. 20, 2016, designating the United States, now pending, and further claims foreign priority benefits to Chinese Patent Application No. 201620363286.4 filed Apr. 27, 2016. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

This disclosure relates to a float switch.

A float switch is a device used to detect the level of liquid within a tank. A conventional float switch includes a junction box, a link mechanism, a support, a switch, and a float. The link mechanism is supported by the support and is driven by buoyancy of the float to open or close the switch. The link mechanism of conventional float switches has a relatively complex structure and it tends to get stuck. This leads to malfunction.

SUMMARY

Disclosed is a float switch that is well-sealed.

The disclosure provides a float switch comprising a junction box, a switch, a guide rod, a float, a link mechanism, and a seal assembly. The switch is disposed in the junction box; the junction box is tightly coupled to the link mechanism; the float is flexibly disposed on the guide rod; the link mechanism comprises a sealing member, a cylindrical pin, a connecting rod, a support, and a shift fork; one end of the link mechanism is connected to the switch via the shift fork, and the other end of the link mechanism is connected to the guide rod; the support comprises a first through hole and a second through hole which are perpendicular to one another; the connecting rod comprises a through hole corresponding to the second through hole of the support; the connecting rod runs through the first through hole of the support; the connecting rod is fixed on the support via the cylindrical pin passing through the through hole of the connecting rod and the second through hole of the support; the seal assembly comprises a washer, a press cover, and an O-ring; the press cover is disposed on the washer, and the washer is disposed on the sealing member to radially seal the connecting rod; a lip seal is provided between the sealing member and the connecting rod, and the O-ring is disposed on the lip seal.

The first through hole of the support can be square, and the support can comprise a circumferential asymmetric protrusion. The junction box can comprise an axial step, and the axial step can comprise a pit corresponding to the circumferential asymmetric protrusion.

The connecting rod can comprise grooves, and the sealing member can comprise raised ribs corresponding to the grooves.

The sealing member further can comprise a groove corresponding to the O-ring of the seal assembly, and a ring seal.

The shift fork can comprise two bulges, and the connecting rod can comprise two depressions corresponding to the two bulges; and the shift fork can be integrated with the connecting rod through the two depressions and the two bulges.

The press cover and the junction box can be in threaded connection or interference fit.

Advantages of the float switch according to embodiments of the disclosure are summarized as follows. The rotation of the link mechanism is flexible and smooth, reducing the probability of being stuck. The float switch is relatively well-sealed and has relatively long service life.

DETAILED DESCRIPTION

To further illustrate, embodiments detailing a float switch are described below. It should be noted that the following embodiments are intended to describe and not to limit the disclosure.

Figure 1:
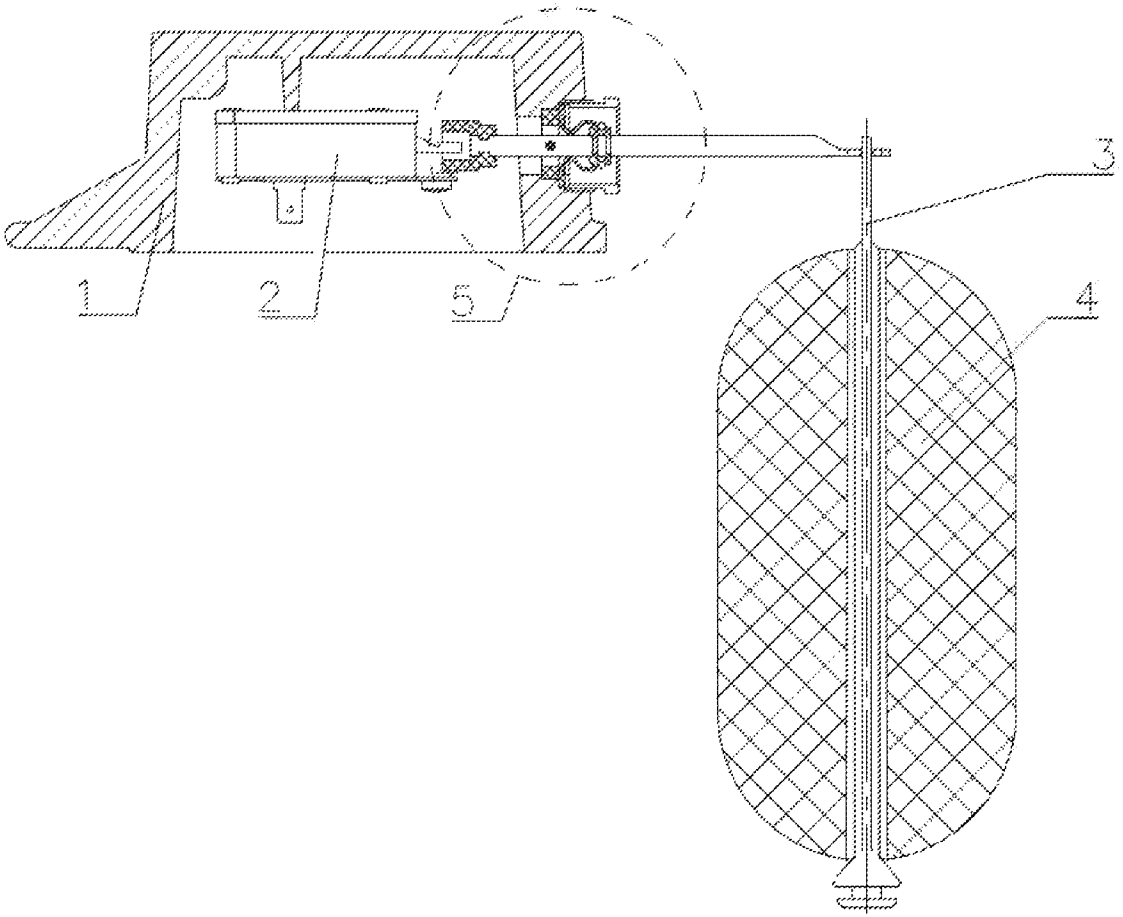
FIG. 1 is a schematic diagram of a float switch as described in the disclosure.
Figure 2:
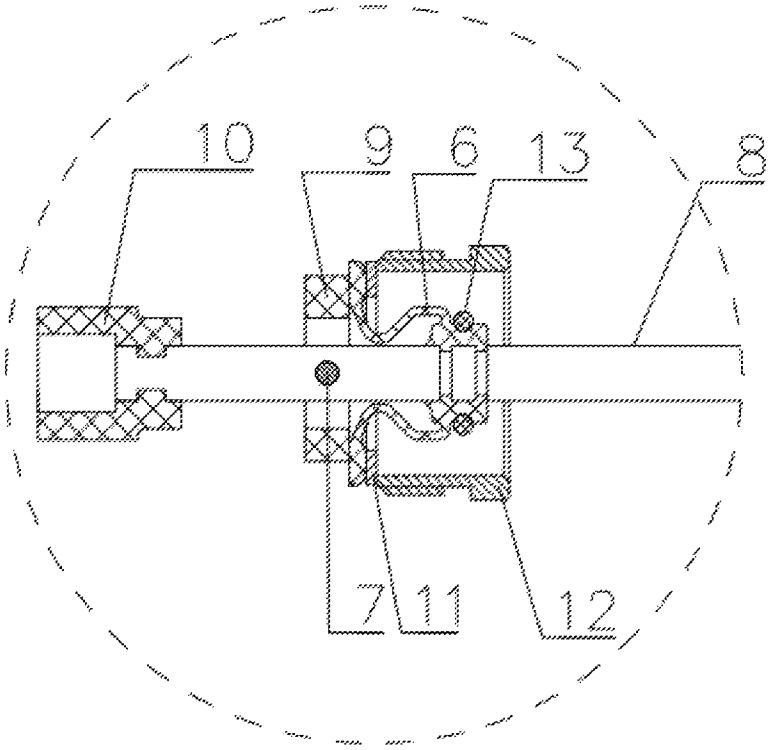
FIG. 2 is an enlarged view of a link mechanism of a float switch as described in the disclosure.
Figure 3:
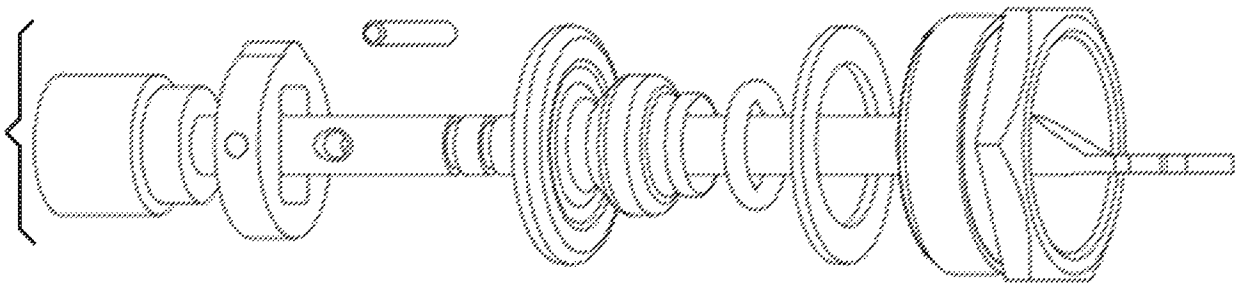
FIG. 3 is a schematic diagram of a link mechanism of a float switch as described in the disclosure.
Figure 4:
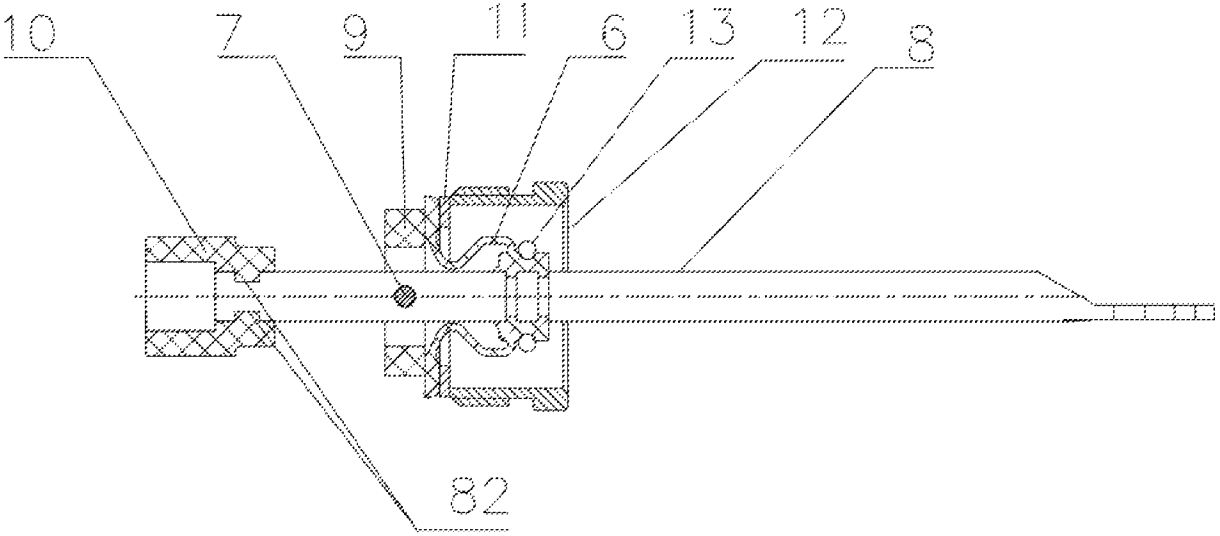
FIG. 4 is a sectional view of a link mechanism of a float switch as described in the disclosure.

Referring to FIG. 1, a float switch for a submersible electric pump comprises a junction box 1, a switch 2, a guide rod 3, a float 4, a link mechanism 5, and a seal assembly. The switch 2 is disposed in the junction box 1. The junction box 1 is tightly coupled to the link mechanism 5. The float 4 is flexibly disposed on the guide rod 3. The link mechanism 5 is coupled to the guide rod and the float 4 outside of the junction box 1 to connect or disconnect the switch 2 in the junction box 1.

Referring to FIGS. 2-7, the link mechanism 5 comprises a sealing member 6, a cylindrical pin 7, a connecting rod 8, a support 9, and a shift fork 10; one end of the link mechanism 5 is connected to the switch 2 via the shift fork 10, and the other end of the link mechanism is connected to the guide rod. The support comprises a first through hole 91 and a second through hole 93 which are perpendicular to one another. The connecting rod comprises a through hole 83 corresponding to the second through hole 93 of the support. The connecting rod 8 runs through the first through hole 91 of the support. The cylindrical pin 7 passes through the through hole 83 of the connecting rod 8 and the second through hole of the support to fix the connecting rod 8 on the support. The cylindrical pin 7 functions as a fulcrum and rotary shaft of the link mechanism 5. Under the action of gravity and buoyance, the float 4 drives the connecting rod 8 to move up and down in the first through hole 91 of the support 9 around the cylindrical pin 7.

The seal assembly comprises a washer 11, a press cover 12, and an O-ring 13. The press cover is disposed on the washer 11, and the washer 11 is disposed on the sealing member 6 to radially seal the connecting rod 8; a lip seal is provided between the sealing member 6 and the connecting rod 8, and the O-ring is disposed on the lip seal, to improve the durability of the sealing.

Figure 5:
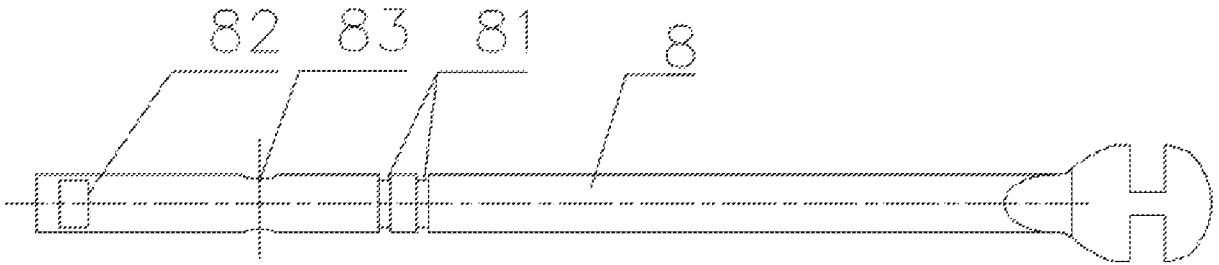
FIG. 5 is a top view of a link mechanism of a float switch as described in the disclosure.
Figure 6:
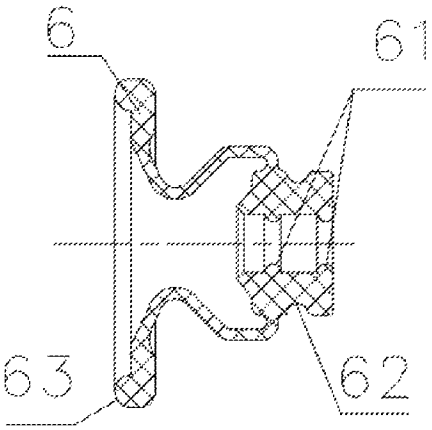
FIG. 6 is a schematic diagram of a sealing member of a float switch as described in the disclosure.

Referring to FIGS. 5 and 6, the connecting rod comprises two grooves 81, and the sealing member 6 comprises two raised ribs 61 corresponding to the two grooves 81. The two raised ribs 61 are respectively embedded in the two grooves 81, thus further locating the sealing member and improving the sealing properties. The sealing member 6 further comprises a groove 62 corresponding to the O-ring 13 of the seal assembly and a ring seal 63. The shift fork 10 comprises two bulges, and the connecting rod comprises two depressions 82 corresponding to the two bulges. The shift fork 10 is integrated with the connecting rod through the two depressions and the two bulges, thus preventing the detachment of the shift fork from the connecting rod.

Figure 7:
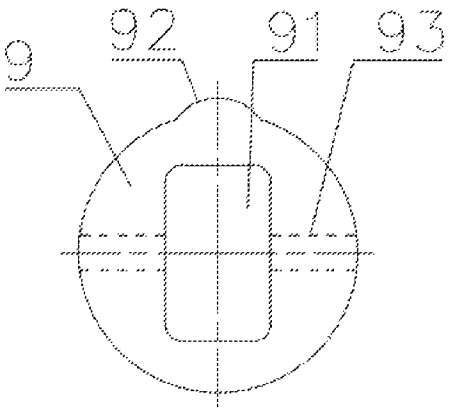
FIG. 7 is a schematic diagram of a support of a float switch as described in the disclosure.

Referring to FIG. 7, the first through hole 91 of the support is square, and the support further comprises a circumferential asymmetric protrusion 92. The junction box comprises an axial step; and the axial step comprises a pit corresponding to the circumferential asymmetric protrusion.

Figure 8:
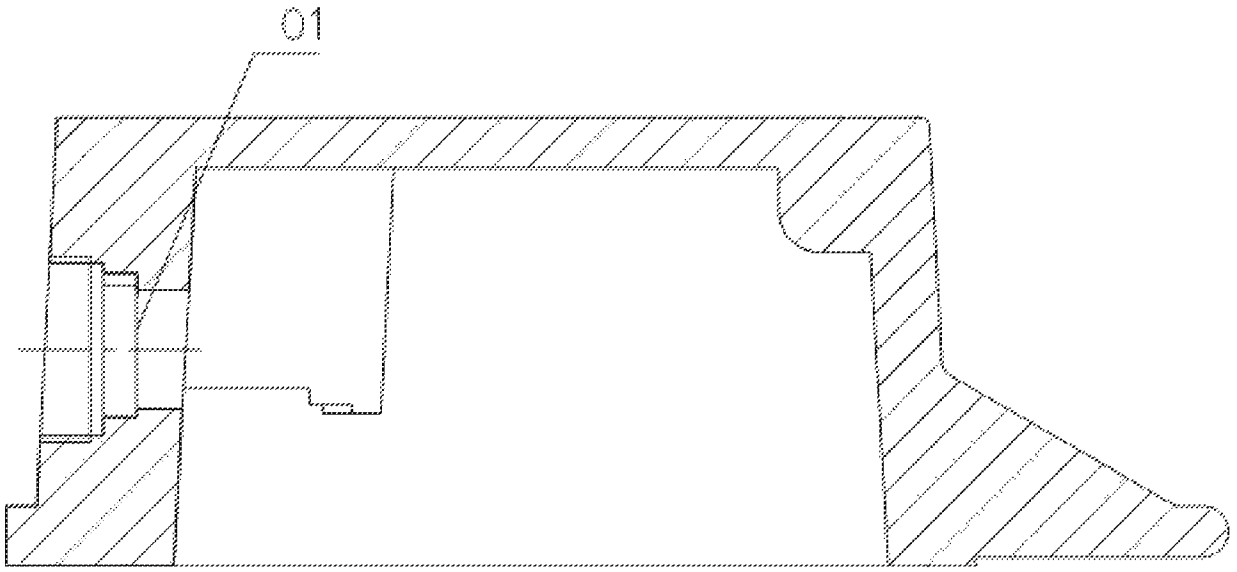
FIG. 8 is an assembly diagram of a link mechanism of a float switch as described in the disclosure.
Figure 9:
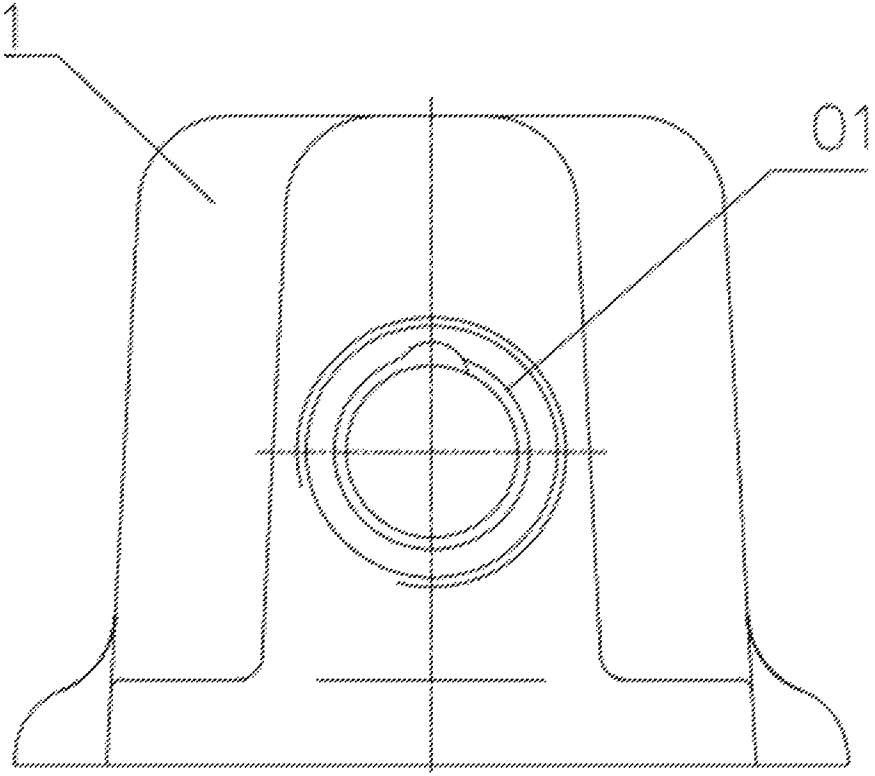
FIG. 9 is a side view of an assembled link mechanism of a float switch as described in the disclosure.

Referring to FIGS. 8 and 9, the junction box 1 comprises an axial step 01 to fix the support 9, and the press cover 12 and the junction box 1 are in threaded connection or interference fit. The axial step comprises a groove for accommodating the support. The circumferential asymmetric protrusion 92 of the support is located in the groove of the axial step 01, preventing the rotation of the support and fixing the support 9 in the junction box 1.

It will be obvious to those skilled in the art that changes and modifications may be made, and therefore, the aim in the appended claims is to cover all such changes and modifications.

What is claimed is:

1. A float switch, comprising:

a junction box;

a switch;

a guide rod;

a float;

a link mechanism; and a seal assembly;

wherein:

the switch is disposed in the junction box;

the junction box is tightly coupled to the link mechanism;

the float is flexibly disposed on the guide rod;

the link mechanism comprises a sealing member, a cylindrical pin, a connecting rod, a support, and a shift fork;

one end of the link mechanism is connected to the switch via the shift fork, and the other end of the link mechanism is connected to the guide rod;

the support comprises a first through hole and a second through hole which are perpendicular to one another; the connecting rod comprises a through hole corresponding to the second through hole of the support; the connecting rod runs through the first through hole of the support; the connecting rod is fixed on the support via the cylindrical pin passing through the through hole of the connecting rod and the second through hole of the support;

the seal assembly comprises a washer, a press cover, and an O-ring; and the press cover is disposed on the washer, and the washer is disposed on the sealing member to radially seal the connecting rod; a lip seal is provided between the sealing member and the connecting rod, and the O-ring is disposed on the lip seal.

2. The switch of claim 1, wherein:

the first through hole of the support is square;

the support further comprises a circumferential asymmetric protrusion;

the junction box comprises an axial step; and the axial step comprises a pit corresponding to the circumferential asymmetric protrusion.

3. The switch of claim 2, wherein the connecting rod comprises grooves, and the sealing member comprises raised ribs corresponding to the grooves.

4. The switch of claim 3, wherein the sealing member further comprises a groove corresponding to the O-ring of the seal assembly, and a ring seal.

5. The switch of claim 4, wherein the shift fork comprises two bulges, and the connecting rod comprises two depressions corresponding to the two bulges; and the shift fork is integrated with the connecting rod through the two depressions and the two bulges.

6. The switch of claim 5, wherein the press cover and the junction box are in threaded connection or interference fit.

* * * * *